US006345523B1

(12) United States Patent
Kuo

(10) Patent No.: US 6,345,523 B1
(45) Date of Patent: Feb. 12, 2002

(54) FIGURE WHEEL OF A COMBINATION LOCK

(76) Inventor: Lambert Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 09/672,088

(22) Filed: Sep. 29, 2000

(51) Int. Cl.[7] ..... E05B 15/14
(52) U.S. Cl. ..... 70/323; 70/312
(58) Field of Search ..... 70/323, 324, 312, 70/DIG. 24, DIG. 76, 51, 291, 301, 304, 315, 316

(56) References Cited

U.S. PATENT DOCUMENTS

| | | | | |
|---|---|---|---|---|
| 145,618 A | * 12/1873 | Brettell | ..... | 70/316 |
| 2,272,689 A | * 2/1942 | Falla-Caravino | ..... | 70/312 |
| 2,858,691 A | * 11/1958 | Hoffman | ..... | 70/323 |
| 4,353,231 A | * 10/1982 | Uyeda | ..... | 70/316 |
| 5,125,248 A | * 6/1992 | Ling | ..... | 70/25 |

FOREIGN PATENT DOCUMENTS

| | | | | |
|---|---|---|---|---|
| CH | 91075 | * 10/1921 | ..... | 70/312 |
| GB | 1135180 | * 12/1968 | ..... | 70/316 |
| GB | 2184157 A | * 6/1987 | ..... | 70/312 |

* cited by examiner

*Primary Examiner*—Lloyd A. Gall
(74) *Attorney, Agent, or Firm*—Rosenberg, Klein & Lee

(57) ABSTRACT

A figure wheel of a combination lock has a hollow wheel body with a contact ring securely attached therearound. The wheel body has an annular portion integrally formed therein, an engagement gearing integrally formed at an inner side of the annular portion, a filling opening defined in an outer side of the annular portion, raised figure marks integrally formed on an outer surface of the wheel body and an annular recess defined in a remaining area of the outer surface of the wheel body. The contact ring of the figure wheel is formed by injecting a slip-resistant plastic material into the annular recess from the filling opening via the throat, whereby the outer surface of the figure wheel is slip-resistant and the figure marks of the figure wheel are firm and abrasion-resistant.

2 Claims, 4 Drawing Sheets

FIGURE WHEEL OF A COMBINATION LOCK

BACKGROUND OF THE INVENTION

1. Field of the Invention

The present invention relates to a figure wheel of a combination lock, particularly to a figure wheel having a wheel body with raised figure marks integrally formed thereon and a slip resistant contact ring securely attached therearound.

2. Description of Related Art

In a first conventional figure wheel of a combination lock as shown in FIG. 5, a wheel body (80) is defined with figure recesses (81) in an outer surface thereof. A packing material with a color different to the color of the wheel body (80) is applied into the figure recesses (81) to enhance figure marks (82) on the outer surface of the wheel body (80). Although this type of figure wheel is improved in comparison with some other types of figure wheels which have their figure marks directly printed on their outer surfaces, the figure marks (82) are still subject to abrasion and have the possibility of separating from the figure recesses (81).

In order to obviate the defect of the above disclosed figure wheel, a second conventional figure wheel is designed. With reference to FIGS. 6 and 7, the second figure wheel has a body (90) with figure grooves (91) defined therein, a hollow shaft (92) integrally formed in a center thereof, and an annular recess (94) defined therein communicated with the figure grooves (91). Connecting strips (93) are respectively provided in some of the figure grooves (91) to ensure internal separated blocks of the figures, such as four, six, eight, nine and zero are connected with the body (90). The figure grooves (91) and the annular recess (94) are filled with a plastic material, in such a way that the figures are marked out. The figure marks are thus prevented from being separated from the wheel body (90).

The above-disclosed two conventional figure wheels have completely the same design of their outer appearance, and this results in the following operational problems occurring with both of them:

(1) As the wheel bodies (80, 90) are abraded repeatedly when they are rotated by users, the surfaces of the wheel body (80, 90) become so smooth that a finger of a user often slips on the surface of the wheel body (80, 90) and so the users may experience frustration in trying to select the correct combination.

(2) The sensation from touching the conventional figure wheels is also not good.

(3) The annular space (94) is too big to be always evenly filled with the plastic material, therefore products are occasionally produced where portions of the figure grooves (91) are not filled with the plastic material.

Therefore, it is an objective of the invention to provide a figure wheel of a combination lock to mitigate and/or obviate the aforementioned problems.

SUMMARY OF THE INVENTION

A main object of the invention is to provide a figure wheel of a combination lock to overcome disadvantages of the conventional figure wheels. The figure wheel of the invention has a hollow wheel body with a contact ring securely attached therearound. The wheel body has an annular portion integrally formed therein and an engagement gearing integrally formed on an inner side of the annular portion. A filling opening is defined in an outer side of the annular portion and communicated with an annular recess via a throat defined in the wheel body. The annular recess is defined in an outer surface of the wheel body between two raised edges respectively formed along opposite ends of the outer surface of the wheel body, and has a same height with raised figure marks which are integrally formed on the outer surface of the wheel body. A plastic material, which is softer than that of the wheel body and has a color different to the color of the wheel body, is applied into the annular recess from the filling opening via the throat and fills the annular recess, the throat and filling opening completely. When the plastic material has hardened, the contact ring made from the plastic material is securely attached around the wheel body. As the figure marks of the figure wheel are integrally formed with the wheel body, they are firm and abrasion-resistant.

A further object of the invention is to provide the figure wheel of the combination lock, wherein the contact ring is made from the plastic material, and the plastic material is softer than the material of the wheel body and has a color different to the color of the wheel body. Therefore the outer surface of the contact ring of the figure wheel is slip-resistant for convenience of users and can provide a pleasant sensation when touched.

Other objects, advantages and novel features of the invention will become more apparent from the following detailed description when taken in conjunction with the accompanying drawings.

DETAILED DESCRIPTION OF THE PREFERRED EMBODIMENT

Figure 1:
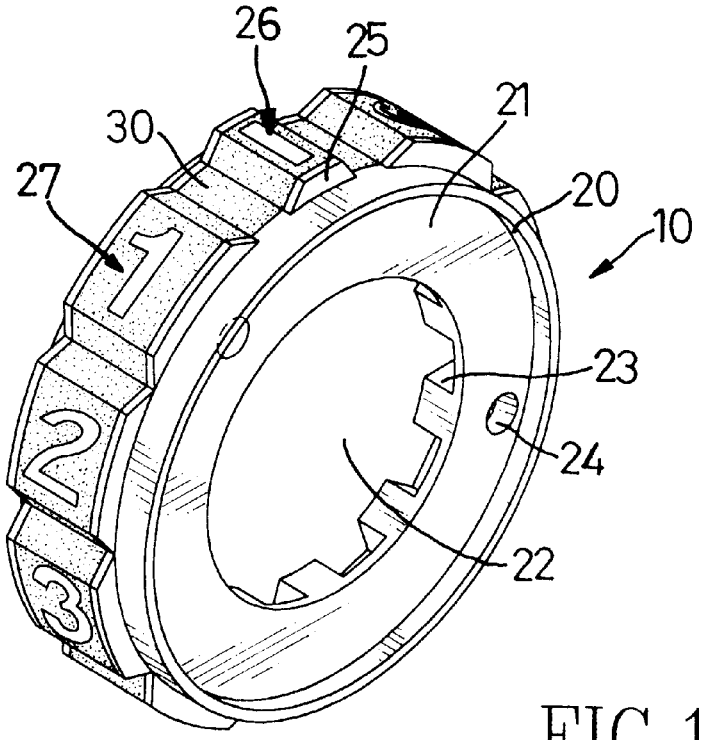
FIG. 1 is a perspective view of a figure wheel of a combination lock in accordance with the invention
Figure 2:
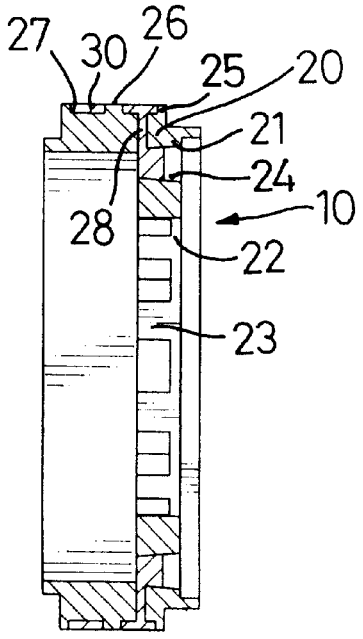
FIG. 2 is a cross sectional view of the figure wheel in accordance with the invention.

As shown in FIGS. 1 and 2, the present invention relates to a figure wheel (10) of a combination lock. The figure wheel (10) comprises a hollow wheel body (20) and a contact ring (30) securely attached around an outer surface of the wheel body (20).

Figure 3:
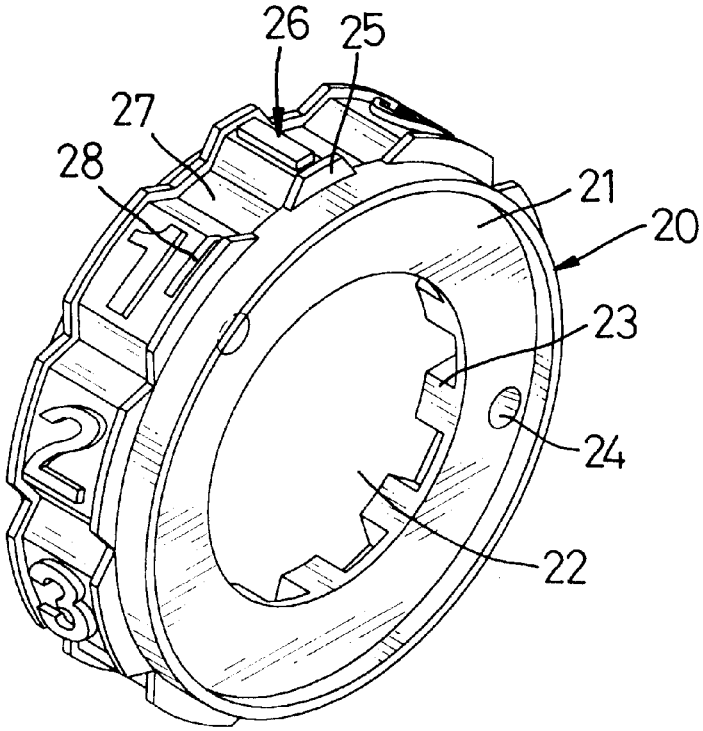
FIG. 3 is a perspective view of a wheel body of the figure wheel in accordance with the invention.
Figure 4:
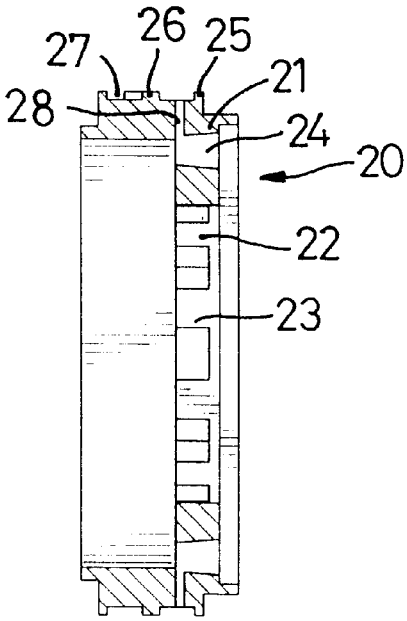
FIG. 4 is a cross sectional view of the wheel body of the figure wheel in accordance with the invention.
Figure 5:
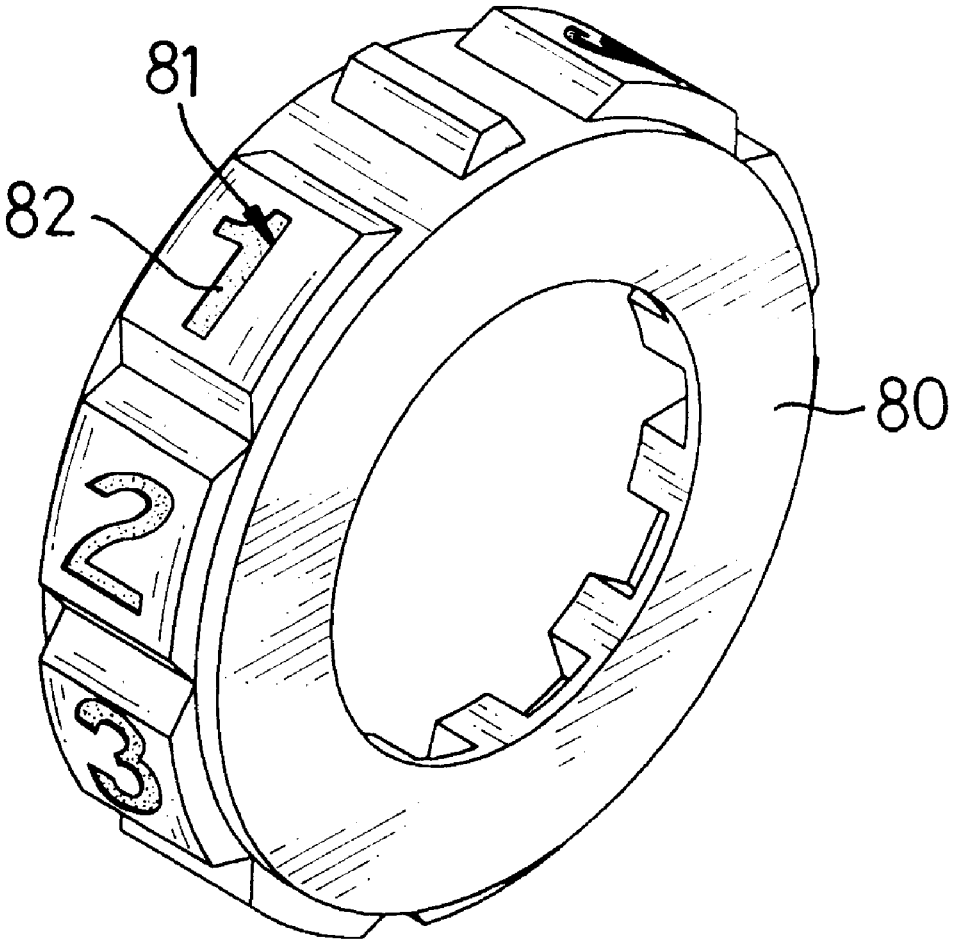
FIG.5 PRIOR ART
FIG. 5 is a perspective view of a first conventional figure wheel.
Figure 6:
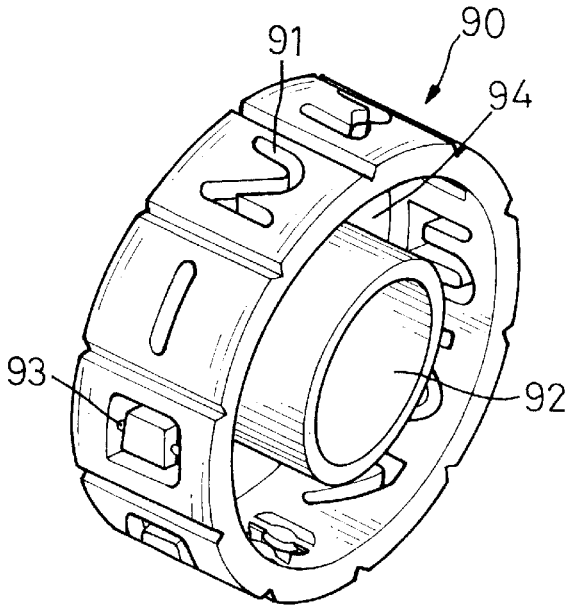
FIG.6 PRIOR ART
FIG. 6 is a perspective view of a second conventional figure wheel.
Figure 7:
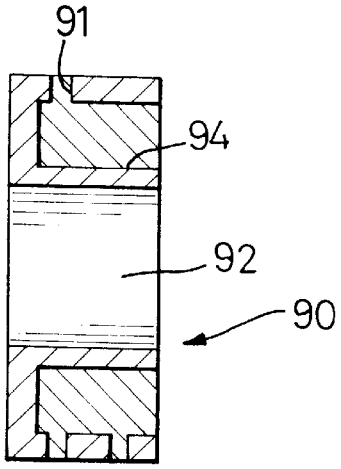
FIG.7 PRIOR ART
FIG. 7 is a cross sectional view of the second conventional figure wheel.

As best seen in FIGS. 3 and 4, the wheel body (20) has an annular portion (21) integrally formed therein, a hole (22) defined in a center of the annular portion (21), an engagement gearing (23) integrally formed at an inner side of the annular portion (21), and a filling opening (24) defined in an outer side of the annular portion (21).

Raised figure marks (26) are integrally formed on the outer surface of the wheel body (20)and a remaining area of the outer surface of the wheel body (20) is defined with an annular recess (27), which is communicated with the filling opening (24) via a throat (28) defined in the wheel body (20).

The annular recess (27) is preferably defined between two raised edges (25) integrally formed along opposite ends of the outer surface of the wheel body (20). The raised figure marks (26) each have a height the same as the raised edges (25).

A plastic material is injected into the annular recess (27) from the filling opening (24) via the throat (28), and thus the contact ring (30) is formed when the plastic material has hardened in the annular recess (27), the throat (28) and the opening (24). The plastic material is preferably a slip-resistant material which is softer than the material of the wheel body (20) and has a color different to the color of the wheel body (20), From the above description, it is noted that the invention has the following advantages:

1. As the figure marks (26) are integrally formed with the wheel body (20), they are firm and abrasion-resistant;
2. As the contact ring (30) is formed of the slip-resistant plastic material which is softer than that of the wheel body (20), the surface of the contact ring (30) is slip-resistant and provides a comfortable touch sensation.
3. As the structure of the figure wheel (10) is simple and easy to be fabricated, and the filling opening (24) and the throat (28) are only one passage communicated with the annular recess (27), the plastic material can be applied into the annular recess (27) completely and evenly, such that the production rate of finished products is high.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A figure wheel (10) of a combination lock comprising a hollow wheel body (20) and a slip-resistant contact ring (30) securely attached around an outer surface of the wheel body (20), wherein the improvements comprise:

the wheel body (20) has an annular portion (21) integrally formed therein, an engagement gearing (23) integrally formed at an inner side of the annular portion (21), a filling opening (24) defined in an outer side of the annular portion (21), raised identification marks (26) integrally formed on the outer surface of the wheel body (20), and an annular recess (27) defined in a remainder area not occupied by the raised identification marks (26) of the outer surface of the wheel body (20) and communicated with the filling opening (24) via a throat (28) defined in the wheel body (20); and the contact ring (30) is formed by injecting a plastic material from the filling opening (24) into the annular recess (27) via the throat (28) and filling the annular recess (27), the throat (28) and the filling opening (24) completely.

2. The figure wheel of the combination lock as claimed in claim 1, wherein the annular recess (27) is defined in the outer surface of the wheel body (20) between two raised edges (25) integrally formed along opposite ends of the wheel body (20).

* * * * *